US011085715B2

(12) United States Patent
Stroda

(10) Patent No.: US 11,085,715 B2
(45) Date of Patent: Aug. 10, 2021

(54) BOLT STOP ACTUATOR FOR USE IN A FIREARM

(71) Applicant: James Dean Stroda, Cocoa, FL (US)

(72) Inventor: James Dean Stroda, Cocoa, FL (US)

(73) Assignee: DIAMONDBACK FIREARMS LLC, Cocoa, FL (US)

( * ) Notice: Subject to any disclaimer, the term of this patent is extended or adjusted under 35 U.S.C. 154(b) by 0 days.

(21) Appl. No.: 16/933,634

(22) Filed: Jul. 20, 2020

(65) Prior Publication Data

US 2021/0018284 A1 Jan. 21, 2021

Related U.S. Application Data

(60) Provisional application No. 62/876,315, filed on Jul. 19, 2019.

(51) Int. Cl.

| | |
|---|---|
| ***F41A 3/68*** | (2006.01) |
| ***F41A 17/36*** | (2006.01) |
| ***F41A 9/65*** | (2006.01) |
| *F41A 3/66* | (2006.01) |

(52) U.S. Cl.

CPC ..... *F41A 3/68* (2013.01); *F41A 9/65* (2013.01); *F41A 17/36* (2013.01); *F41A 3/66* (2013.01)

(58) Field of Classification Search

CPC .... F41A 3/68; F41A 9/65; F41A 17/36; F41A 3/66

USPC ..... 42/69.02

See application file for complete search history.

(56) References Cited

U.S. PATENT DOCUMENTS

| | | | | |
|---|---|---|---|---|
| 7,661,219 | B1 * | 2/2010 | Knight, Jr. | F41A 35/06 42/70.02 |
| 8,359,966 | B1 * | 1/2013 | Brotherton | F41A 17/36 89/181 |
| 9,091,499 | B2 * | 7/2015 | Overstreet | F41A 9/70 |
| 10,180,298 | B2 * | 1/2019 | Noonan | F41A 17/36 |
| 10,670,359 | B2 * | 6/2020 | Indruch | F41A 17/36 |
| 2011/0247483 | A1 * | 10/2011 | Overstreet | F41A 9/70 89/138 |
| 2012/0167424 | A1 * | 7/2012 | Gomez | F41A 35/06 42/14 |
| 2017/0160032 | A1 * | 6/2017 | Overstreet | F41A 17/36 |
| 2017/0241729 | A1 * | 8/2017 | Gangl | F41A 17/36 |
| 2017/0284761 | A1 * | 10/2017 | Lewis | F41A 17/36 |
| 2017/0299303 | A1 * | 10/2017 | Phipps | F41A 17/36 |
| 2019/0137202 | A1 * | 5/2019 | Facchini | F41A 17/36 |
| 2020/0182571 | A1 * | 6/2020 | Noonan | F41A 17/36 |
| 2020/0263944 | A1 * | 8/2020 | Harris | F41A 17/36 |
| 2020/0300565 | A1 * | 9/2020 | Romano | F41A 17/42 |
| 2021/0018284 | A1 * | 1/2021 | Stroda | F41A 9/65 |

* cited by examiner

*Primary Examiner* — Joshua E Freeman

(74) *Attorney, Agent, or Firm* — Kutak Rock LLP

(57) ABSTRACT

A bolt stop actuator is disclosed. The actuator may include a lift arm, a first leg extending from a point proximate to an end of the lift bar and generally perpendicular therefrom, a second leg extending in the same direction from the lift bar as the first leg, and a projection extending from the lift bar and configured to contact a follower of an empty magazine when the bolt stop actuator is assembled into a firearm. Neither the first leg, nor the second leg, include apertures positioned distal to the lift arm.

19 Claims, 6 Drawing Sheets

BOLT STOP ACTUATOR FOR USE IN A FIREARM

CROSS-REFERENCE TO RELATED APPLICATIONS

This application claims priority to U.S. Provisional Patent Application Ser. No. 62/876,351, titled Bolt Stop Actuator for Use in a Firearm filed on Jul. 19, 2019.

BACKGROUND

This specification relates generally to firearm components. In particular, this specification relates to an improved bolt stop actuator for use in conjunction with a bolt stop in a semiautomatic firearm.

The present specification provides a bolt stop actuator that is retained without additional pins, resulting in simplified manufacturing and assembly processes.

DETAILED DESCRIPTION

Figure 1:
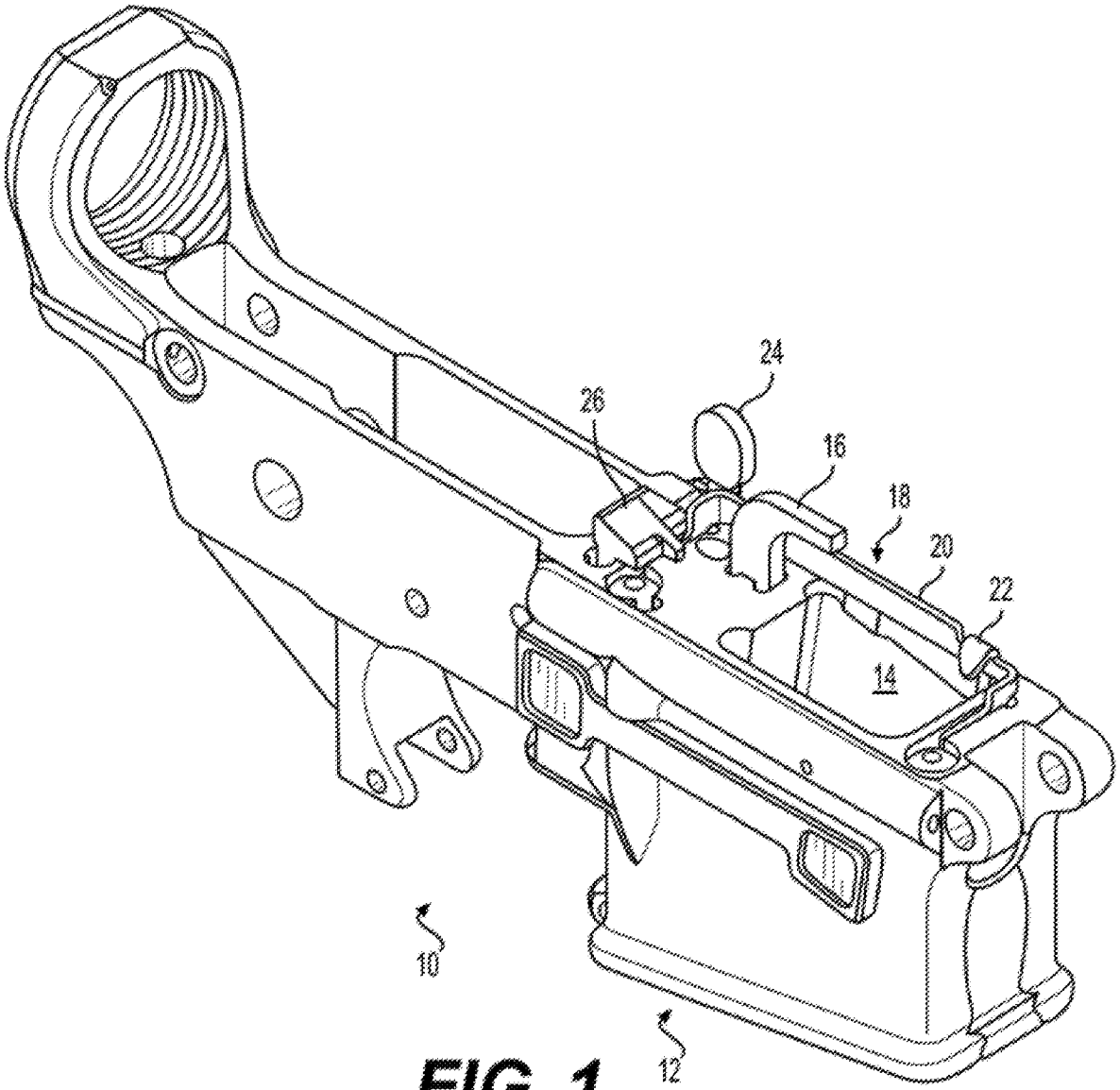
FIG. 1, is a perspective view of a firearm receiver including a bolt stop actuator.

Referring to FIG. 1, a firearm receiver 10, shown as a modified AR-15 pattern lower receiver is provided and includes a magazine well 12 having an upper opening 14. An ejector 16 extends forward from a position to the rear of magazine well 12. Ejector 16 is positioned to contact the rear of shell casing when the casing is extracted, thus causing the casing or round to be ejected.

Bolt stop actuator 18 is pivotally mounted to receiver 10 and includes lift arm 20 and projection 22. Projection 22 is curved from a top portion of lift arm 20 to provide a contact point for a magazine follower. When a magazine is inserted into magazine well 12, it extends to or through opening 14. When an empty magazine is seated in receiver 10, the follower of the magazine contacts projection 22 and urges lift arm 20 upwardly.

Also shown is bolt release 24 and bolt stop 26. As shown in more detail in the other figures, bolt stop actuator 18, when urged upward by the follower of an empty magazine, displaces bolt stop 26 upwardly into a position such that it interferes with the face of the assembled firearm's bolt and holding it toward the rear of the firearm. A user may depress bolt release 24, which is formed as a single unitary body with bolt stop 26, which lowers bolt stop 26 thereby releasing the bolt of the assembled firearm.

Bolt stop 26 includes projection 32. An underside surface of projection 32 contacts an upper surface 34 (shown in FIG. 4) of leg 26. Bolt stop 26 is biased downward by a spring and, in turn, biases bolt stop actuator 18 downwardly.

Figure 2:
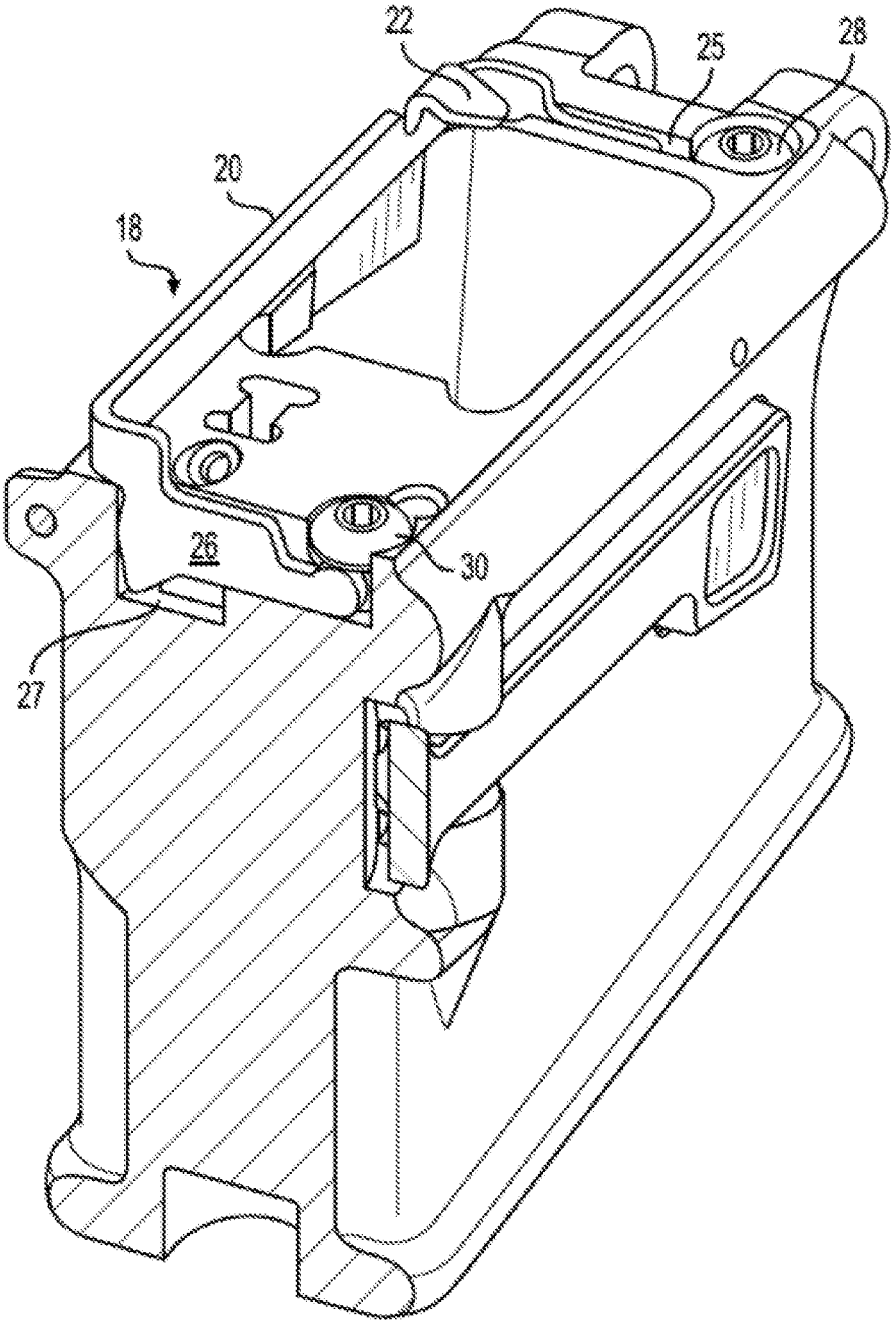
FIG. 2, is a partial cutaway, perspective view of the receiver of FIG. 1.
Figure 3:
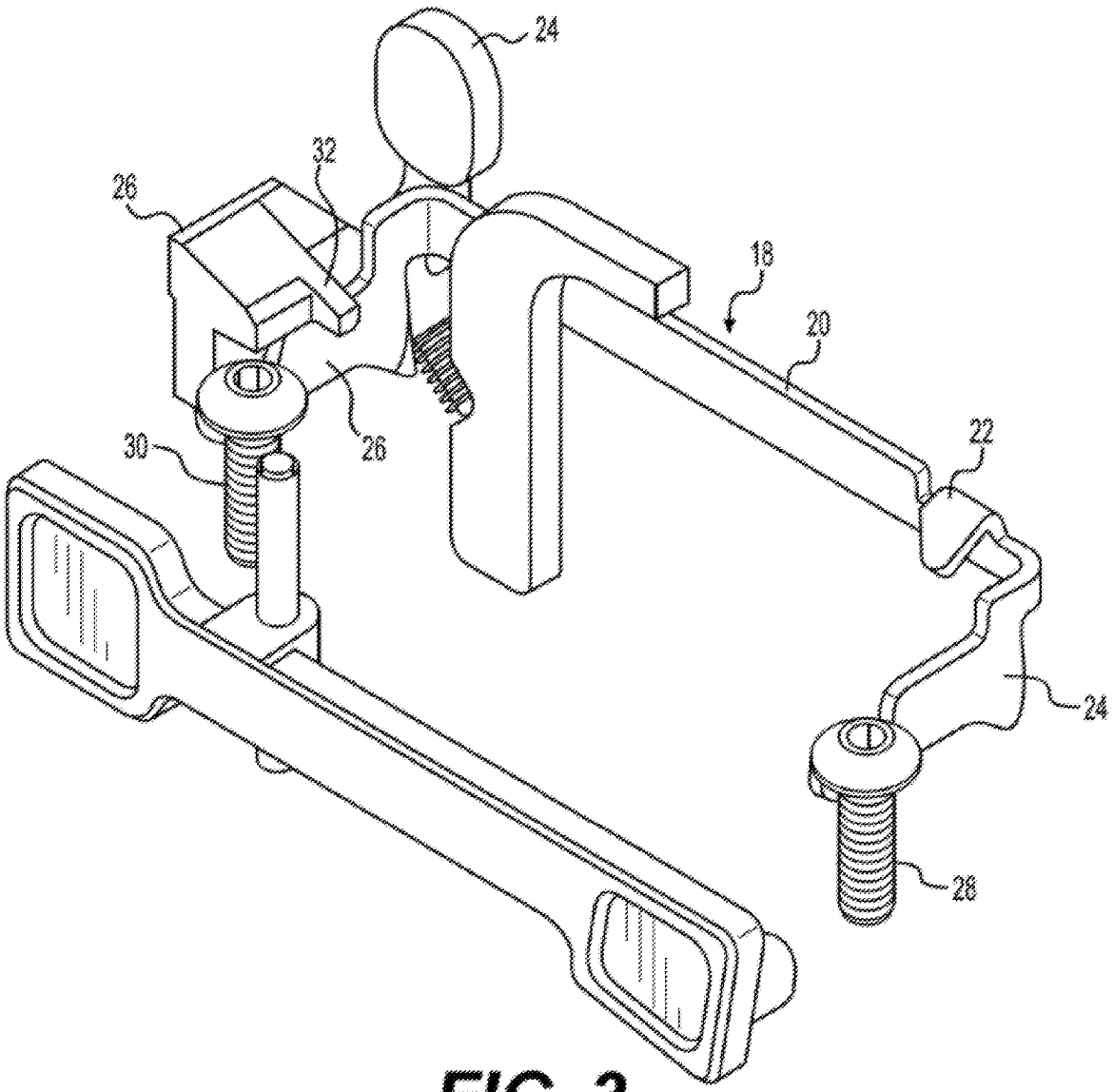
FIG. 3, is a perspective view of a bolt stop and bolt stop assembly actuator.

Referring to FIGS. 2 and 3, bolt stop actuator 18 further includes legs 24 and 26 extending from lift arm 20. In some embodiments, the legs may be generally parallel to each other. In some such embodiments the legs may extend generally perpendicular to the lift arm. Legs 24 and 26 are received in slots 25 and 27 within receiver 10. Bolt stop actuator 18 is retained within receiver 10 by the heads of screws 28 and 30. An underside surface of the heads of screws 28 and 30 restrict the motion of bolt actuator 12 at the ends of legs 24 and 26 distal to lift arm 20.

Figure 4:
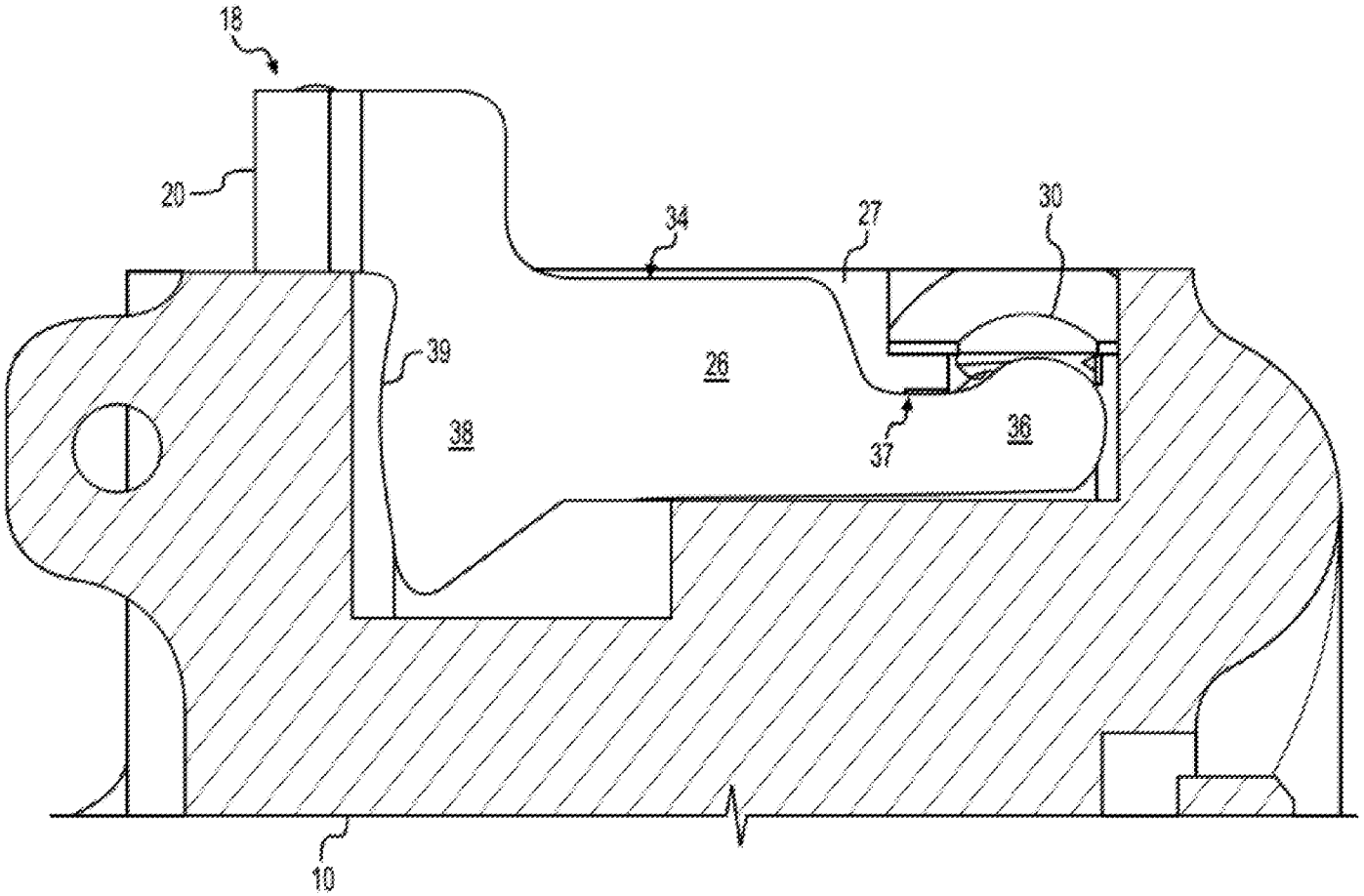
FIG. 4, is a partial, elevation view of the receiver of FIG. 1.

Referring to FIG. 4, bolt stop actuator 18 is shown in a first, unengaged position where it sits relatively low in receiver 10. Leg 26 is disposed within slot 27. Leg 26 includes an end 36 positioned distal to lift arm 20. An underside surface of the head of screw 30 may contact end 36 and retain bolt stop actuator 18 within receiver 10. Region 38 of leg 26 includes an arcuate edge 39 that may maintain contact with an interior surface of slot 27 as bolt stop actuator 18 moves upward.

Figure 5:
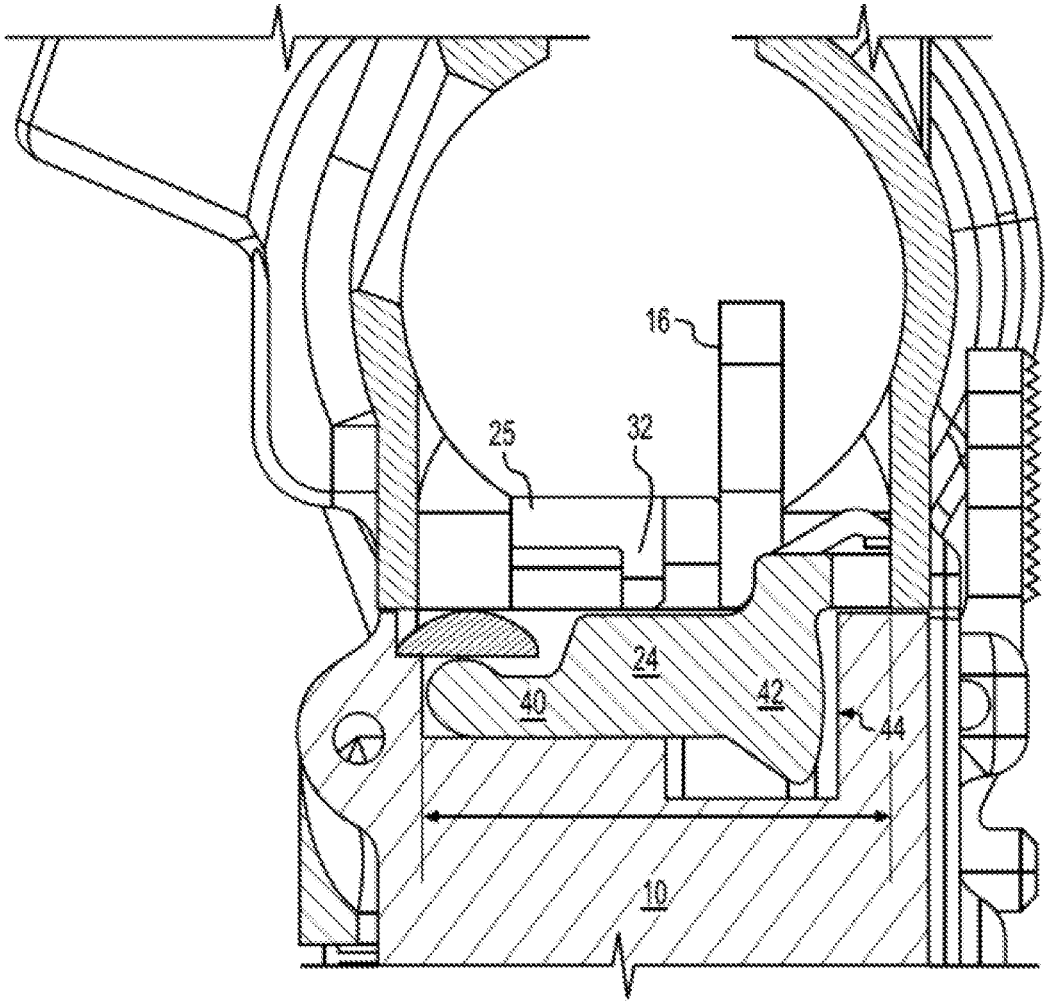
FIG. 5, is a partial, elevation view of the receiver of FIG. 1 with the bolt stop actuator in a first, unengaged position.

Referring to FIG. 5, bolt stop actuator 18 is shown in a first, unengaged position where it sits relatively low in receiver 10. Leg 24 is disposed within slot 25. Leg 24 includes an end 40 positioned distal to lift arm 20. An underside surface of the head of screw 28 may contact end 40 and retain bolt stop actuator 18 within receiver 10. Region 42 of leg 24 includes an arcuate edge 46 that may maintain contact with an interior surface 44 of slot 25 as bolt stop actuator 18 moves.

Figure 6:
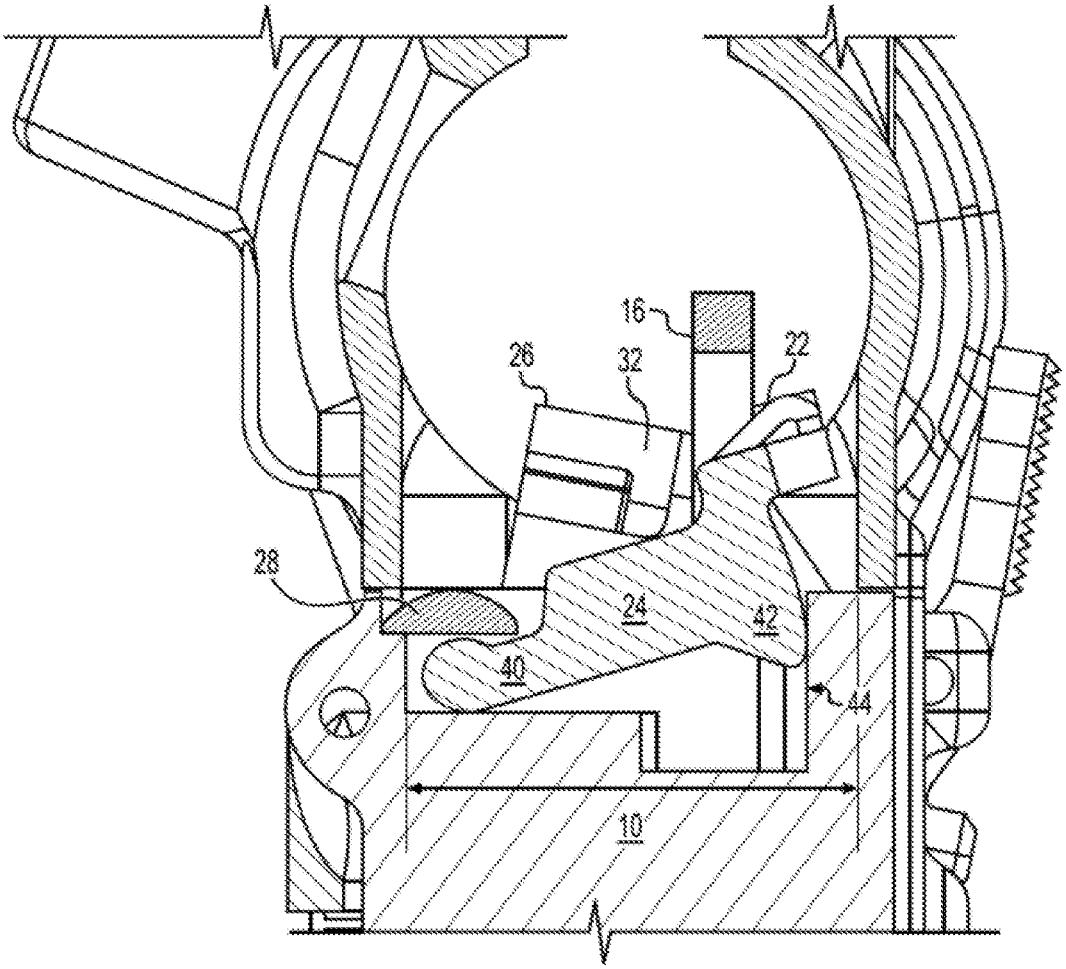
FIG. 6, is a partial, elevation view of the receiver of FIG. 1 with the bolt stop actuator in a second, engaged position.

Referring to FIG. 6, bolt stop actuator 18 is shown in a second, engaged position where it is raised in receiver 10. Leg 24 is disposed within slot 25. Leg 24 includes an end 42 positioned distal to lift arm 20. An underside surface of the head of screw 28 maintains contact with end 40 and retains bolt stop actuator 18 within receiver 10. Region 42 of leg 24 includes an arcuate edge 46 that may maintain contact with an interior surface of slot 25 as bolt stop actuator 18 moves upward.

When the follower of an empty magazine pushes upward on projection 22, bolt stop actuator 18 is moved upwards. This places an upward force on projection 32 of bolt stop 26 proximate to surface 34. Bolt stop 26 is thereby moved upwards into the path of travel of the firearm bolt and retains it in a position to the rear of the firearm. As actuator 18 moves upward near region 42, it both slides laterally and pivots near end 40. The resulting movement places actuator in a position where the distance from a fixed point of the receiver proximate to surface 44 to the furthest edge of end 40 is reduced. Measurements of this are provided on FIGS. 5 and 6 are provided for purposes of illustration only. This results in the ends of legs 24 and 26 distal to lift bar 20 being restricted in the vertical, but not in the horizontal. This results in an actuator that does not truly pivot as there is no fixed pivot point.

In some embodiments, the receiver surface 44 may have a curved profile. This may be used to accomplish the lifting of the lift bar while preventing lateral movement of the bolt stop actuator. Alternatively, other configurations preventing lateral movement of the bolt stop actuator may be used.

In some embodiments, screws 28 and 30 may be replaced by other types of fasteners. In yet other embodiments tabs or other structures extending from an interior surface of the receiver may be used to restrict vertical movement of the legs distal to the lift arm.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description herein is for the purpose of describing particular embodiments only and is not intended to be limiting of the invention. As used in the description of the embodiments and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A bolt stop actuator comprising:

a lift arm;

a first leg extending from a point proximate to an end of the lift arm and generally perpendicular therefrom;

a second leg extending in the same direction from the lift arm as the first leg; and a projection extending from the lift arm and configured to contact a follower of an empty magazine when the bolt stop actuator is assembled into a firearm;

wherein neither the first leg, nor the second leg, include apertures positioned distal to the lift arm;

wherein the bolt stop actuator is configured to be retained in a receiver without the use of pins or projections positioned on either the first leg or the second leg at a point distal to the lift arm.

2. The bolt stop actuator of claim 1, wherein the bolt stop actuator is configured to be laterally displaced when the lift arm is moved from a first, unengaged position to a second, engaged position.

3. The bolt stop actuator of claim 1, wherein said first leg includes a distal end, said distal end positioned distal to the lift arm.

4. The bolt stop actuator of claim 3, wherein a portion of said distal end of said first leg is contacted by a surface of a first fastener.

5. The bolt stop actuator of claim 4, wherein said first fastener restricts the vertical movement of said distal end of said first leg, thereby retaining the bolt stop actuator within the receiver.

6. The bolt stop actuator of claim 5, wherein said first fastener is a screw.

7. The bolt stop actuator of claim 4, wherein said second leg includes a distal end, said distal end positioned distal to the lift arm.

8. The bolt stop actuator of claim 7, wherein a portion of said distal end of said second leg is contacted by a surface of a second fastener.

9. The bolt stop actuator of claim 8, wherein said first and second fasteners restrict the vertical movement of said distal ends of each of said first leg and said second leg, thereby retaining the bolt stop actuator within the receiver.

10. The bolt stop actuator of claim 9, wherein said first and second fasteners are screws.

11. The bolt stop actuator of claim 1, wherein said projection is curved from a top portion of the lift arm to provide a contact point for a magazine follower.

12. The bolt stop actuator of claim 11, wherein the projection urges the lift arm upwardly when an empty magazine is seated in the receiver and contacts the projection.

13. The bolt stop actuator of claim 12, wherein a surface of the bolt stop actuator is moved into the path of travel of a bolt when the lift arm is urged upward, thereby retaining a bolt of a firearm in a restricted position.

14. The bolt stop actuator of claim 1, wherein said first leg includes a region with an arcuate edge, the arcuate edge configured to maintain contact with an interior surface of the receiver as the bolt stop actuator moves between a first position and a second position.

15. The bolt stop actuator of claim 14, wherein said second leg includes a region with an arcuate edge, the arcuate edge configured to maintain contact with the interior surface of the receiver as the bolt stop actuator moves between the first position and the second position.

16. The bolt stop actuator of claim 1, wherein the bolt stop actuator further comprises a bolt stop portion, said bolt stop portion configured to interfere with a bolt of a firearm when in an engaged position.

17. The bolt stop actuator of claim 16, wherein the bolt stop actuator further comprises a bolt release, said bolt release configured to lower said bolt stop when depressed by a user.

18. The bolt stop actuator of claim 17, wherein depressing said bolt release to lower said bolt stop moves the bolt stop actuator from said engaged position to an unengaged position.

19. The bolt stop actuator of claim 18, wherein moving the bolt stop actuator from said engaged position to said unengaged position causes said bolt stop to no longer interfere with said bolt of a firearm.

* * * * *